US007338565B2

(12) United States Patent
Stockert et al.

(10) Patent No.: US 7,338,565 B2
(45) Date of Patent: Mar. 4, 2008

(54) HOUSINGLESS WASHER

(75) Inventors: David L. Stockert, New Boston, MI (US); Timothy P. Tristani, Lake Orion, MI (US); David M. Menzer, Allen Park, MI (US)

(73) Assignee: Cinetic Automation Corporation, Farmington Hills, MI (US)

( * ) Notice: Subject to any disclaimer, the term of this patent is extended or adjusted under 35 U.S.C. 154(b) by 0 days.

(21) Appl. No.: 11/334,799

(22) Filed: Jan. 18, 2006

(65) Prior Publication Data

US 2006/0180181 A1 Aug. 17, 2006

Related U.S. Application Data

(63) Continuation-in-part of application No. 10/646,534, filed on Aug. 21, 2003.

(51) Int. Cl.
*B08B 3/02* (2006.01)

(52) U.S. Cl. ..... 134/33; 134/159; 134/200; 134/148

(58) Field of Classification Search ..... 134/159, 134/200, 148, 158
See application file for complete search history.

(56) References Cited

U.S. PATENT DOCUMENTS

| | | | | |
|---|---|---|---|---|
| 500,206 | A * | 6/1893 | Hoare | 422/102 |
| 2,202,344 | A * | 5/1940 | Hamilton et al. | 134/159 |
| 2,216,698 | A * | 10/1940 | Arey et al. | 134/167 R |
| 2,258,562 | A * | 10/1941 | Arey et al. | 134/58 R |
| 2,393,215 | A * | 1/1946 | Arey et al. | 134/82 |
| 2,405,838 | A | 8/1946 | Lawson et al. | |
| 2,681,069 | A * | 6/1954 | Marshall et al. | 134/175 |
| 2,857,922 | A * | 10/1958 | Effinger | 134/133 |
| 2,873,685 | A | 2/1959 | Umbricht | |
| 2,926,674 | A | 3/1960 | Umbricht et al. | |
| 3,009,468 | A | 11/1961 | Eberle | |
| 3,059,861 | A | 10/1962 | Umbricht et al. | |
| 3,276,458 | A | 10/1966 | Iversen et al. | |
| 3,439,810 | A | 4/1969 | Newman et al. | |
| 3,443,567 | A * | 5/1969 | Moore | 134/58 R |
| 3,605,775 | A | 9/1971 | Zaander et al. | |

(Continued)

FOREIGN PATENT DOCUMENTS

| | | |
|---|---|---|
| CA | 656624 | 1/1963 |

(Continued)

OTHER PUBLICATIONS

Euorpean Patent Office 0 277 275 Jul. 1987.*

(Continued)

*Primary Examiner*—Frankie L. Stinson
(74) *Attorney, Agent, or Firm*—Harness, Dickey & Pierce, P.L.C.

(57) ABSTRACT

An industrial parts washer includes a stand adapted to support a part, a chamber selectively moveable from a first position clear of the part to a second position engaging the stand where the chamber forms a closed volume encapsulating the part. A nozzle is positioned within the chamber to supply pressurized fluid for cleaning the part. The industrial parts washer may include a washing station positioned adjacent a drying station where each of the washing and drying stations include chambers selectively moveable to enclose the part.

29 Claims, 12 Drawing Sheets

U.S. PATENT DOCUMENTS 3,614,231 A 10/1971 Shaw
3,624,750 A * 11/1971 Peterson ..... 134/96.1
3,664,355 A * 5/1972 Adams ..... 134/143
3,801,371 A * 4/1974 Martin ..... 134/95.3
3,870,417 A 3/1975 Bashark
3,888,269 A 6/1975 Bashark
3,889,696 A * 6/1975 Ousterling et al. ..... 134/57 R
4,015,615 A * 4/1977 Weber et al. ..... 134/196
4,054,148 A * 10/1977 Gurr ..... 134/57 R
4,067,293 A * 1/1978 Probst ..... 118/73
4,117,855 A * 10/1978 Olcott et al. ..... 134/141
4,170,240 A 10/1979 Gentry
4,222,250 A 9/1980 Torita
4,317,426 A 3/1982 Wheten
4,323,398 A * 4/1982 Simon ..... 134/18
4,325,161 A 4/1982 Wood et al.
4,350,174 A * 9/1982 Bolten et al. ..... 134/104.4
4,381,794 A 5/1983 Stimac et al.
4,409,999 A 10/1983 Pedziwiatr
4,413,977 A 11/1983 Takano et al.
4,469,526 A * 9/1984 Budinsky et al. ..... 134/25.4
4,493,333 A 1/1985 Layton
4,571,270 A * 2/1986 Sasaki ..... 134/5
4,582,077 A 4/1986 Gabriel et al.
4,600,444 A * 7/1986 Miner ..... 134/8
4,722,295 A * 2/1988 Young ..... 118/416
4,731,154 A 3/1988 Hausman Hazlitt et al.
4,796,042 A 1/1989 Mappin et al.
4,821,753 A 4/1989 Nakamura et al.
4,892,111 A 1/1990 Parslow, Jr. et al.
4,893,320 A 1/1990 Yanagi et al.
4,895,205 A 1/1990 Thompson et al.
4,936,328 A 6/1990 Yatabe
4,941,971 A * 7/1990 Albright ..... 210/107
4,995,409 A 2/1991 Watts
4,996,160 A 2/1991 Hausman Hazlitt et al.
5,000,206 A * 3/1991 Kramer et al. ..... 134/34
5,014,726 A 5/1991 Lindvall
5,143,102 A 9/1992 Blaul
5,154,199 A 10/1992 Thompson et al.
5,172,572 A 12/1992 Ono
5,174,315 A 12/1992 Hellstern et al.
5,188,135 A * 2/1993 Neumann et al. ..... 134/64 R
5,201,958 A 4/1993 Breunsbach et al.
5,265,446 A 11/1993 Kuroda et al.
5,272,892 A 12/1993 Janutka et al.
5,284,523 A 2/1994 Badami et al.
5,291,626 A 3/1994 Molnar et al.
5,330,580 A 7/1994 Whipple, III et al.
5,339,844 A 8/1994 Stanford, Jr. et al.
5,346,629 A 9/1994 Wuller
5,357,648 A 10/1994 Noestheden
5,368,053 A 11/1994 Wilson
5,396,178 A 3/1995 Rybarski
5,411,042 A 5/1995 Suzuki et al.
5,421,883 A * 6/1995 Bowden ..... 118/73
5,444,531 A 8/1995 Foreman et al.
5,464,483 A 11/1995 Avelis et al.
5,470,394 A * 11/1995 Michel et al. ..... 134/25.4
5,545,259 A 8/1996 Suzuki et al.
5,555,583 A 9/1996 Berkcan
5,560,060 A 10/1996 Dausch et al.
5,586,567 A 12/1996 Smith et al.
5,630,435 A 5/1997 Brouchoud et al.
5,640,981 A 6/1997 Niemela et al.
5,647,386 A 7/1997 Kaiser
5,661,872 A 9/1997 Meyer et al.
5,706,840 A 1/1998 Schneider et al.
5,730,163 A 3/1998 Meyer et al.
5,746,233 A 5/1998 Kuroda et al.
5,800,628 A 9/1998 Erickson et al.
5,815,762 A 9/1998 Sakai et al.
5,846,337 A * 12/1998 Uchinami et al. ..... 134/34
5,923,432 A 7/1999 Kral
5,931,173 A 8/1999 Schiele
5,934,869 A 8/1999 Janisse
5,954,070 A 9/1999 Abad et al.
5,954,071 A 9/1999 Magliocca
5,960,804 A 10/1999 Cooper et al.
6,007,640 A 12/1999 Neff et al.
6,073,540 A * 6/2000 Garrett ..... 99/330
6,073,640 A * 6/2000 McTaggart ..... 134/103.1
6,115,541 A 9/2000 Rhodes
6,119,365 A 9/2000 Wuller et al.
6,126,099 A 10/2000 Fachinger et al.
6,129,099 A 10/2000 Foster et al.
6,165,277 A 12/2000 Florez
6,234,080 B1 * 5/2001 Tani ..... 101/424
6,319,329 B1 11/2001 Kamikawa et al.
6,321,760 B1 * 11/2001 Meissner ..... 134/80
6,334,266 B1 * 1/2002 Moritz et al. ..... 34/337
6,342,104 B1 1/2002 Kamikawa et al.
6,467,189 B2 10/2002 Kuroda
6,575,178 B1 6/2003 Kamikawa
6,913,650 B2 * 7/2005 Gilmore et al. ..... 118/66
2001/0015096 A1 8/2001 Hoffman
2003/0121536 A1 7/2003 Kataoka
2005/0039784 A1 2/2005 Stockert et al.
2005/0115593 A1 6/2005 Publ

FOREIGN PATENT DOCUMENTS

CA 667441 7/1963
CA 669262 8/1963
CA 699331 12/1964
CA 699537 12/1964
DE 41 25 891 2/1993
EP 0 065 861 12/1982
EP 0 110 525 6/1984
EP 0 341 184 11/1989
EP 0 368 775 6/1990
EP 1 602 412 12/2005
FR 2690635 * 11/1993
GB 817851 8/1959
GB 817860 8/1959
JP 55-103608 8/1980
JP 56-97512 8/1981
JP 60-16275 1/1985
JP 60-21798 2/1985
JP 60-163689 8/1985
JP 61-25599 2/1986
JP 62-259442 11/1987
JP 2-107296 4/1990
RU 2 018 384 * 8/1994

OTHER PUBLICATIONS

European Patent Office 0 022 307 Jan. 1980.*
Owner's Manual, "Model 215W Liquidborne Laser Particle Counter," (believed to have been published and/or offered for sale in 1995).
Drawing No. 4792692-M-170A05A showing the Daimler-Chrysler Kenosha Plant, Station #5 Seal & Flush, Transfer Machine Serial No. 7100-001, 1 page, (believed to have been offered for sale prior to 2002).

* cited by examiner

HOUSINGLESS WASHER

CROSS-REFERENCE TO RELATED APPLICATIONS

This application is a continuation-in-part of U.S. patent application Ser. No. 10/646,534 filed on Aug. 21, 2003. The disclosure of the above application is incorporated herein by reference.

BACKGROUND AND SUMMARY OF THE INVENTION

The present invention generally relates to a washer for industrial parts and, more particularly, to a washer which eliminates the need for a large enclosure.

Manufactured industrial parts, such as machined metallic components, become coated with cutting fluids, lubricating oils, machine coolants, metal fragments and other contaminants during the manufacturing process. For example, metal cutting operations often include the steps of applying a lubricant to the cutting tool and part being machined. Lubricant residue and metal chips often adhere to the surface of the part. Industrial parts washers are used to remove undesired contaminants and clean the part prior to use.

Industrial parts washers typically include one or more processing zones for washing, rinsing, drying and other steps for cleaning the parts. A conveyor typically transports the parts through the processing zones from one end of the washer to the other. Because industrial parts washers typically spray the parts with heated liquid cleaners, most washers include an enclosure to capture the spray and contaminants being washed.

The enclosure of a typical industrial parts washer ordinarily incorporates a large metal housing which extends along nearly the entire length of the machine. Although such enclosures have proven to be quite durable and relatively easy to fabricate, they are large, unwieldy and relatively costly. Access to the machines within the enclosure is oftentimes limited thereby making maintenance and retooling of the machines difficult. Furthermore, because the majority of the machines used to wash, rinse and dry the part are located within the enclosure, the machines are detrimentally exposed to the harsh solvent spray throughout their life.

Several manufacturers of industrial parts washers have attempted to address the problem of access by adding doors or removable side panels to the side of the enclosure. However, the restricted openings hinder access to the interior volume of the enclosure. Other manufacturers have attempted to provide an enclosure which is removable in its entirety. However, due to the size and weight of the requisite enclosure, mechanical lifts or cranes are usually needed to raise the enclosure. Accordingly, there is a need for a housingless industrial parts washer having reduced size and complexity.

SUMMARY OF THE INVENTION

The industrial parts washer of the present invention includes a stand adapted to support the part to be washed and a moveable chamber. The chamber is moveable from a returned position clear of the part to an advanced position engaging the stand where the chamber and the stand form a sealed unit encapsulating the part. A nozzle assembly is coupled to a pressurized fluid supply and positioned within the chamber.

In one embodiment, a moveable wash ring having a plurality of manifold mounted nozzles mounted thereto is advanced across the part during the washing cycle. The nozzles are positioned substantially about the periphery of the part to provide a plurality of fluid paths for washing strategic areas of the part.

In another embodiment, the industrial parts washer of the present invention includes a washing station and a drying station. The drying station is positioned downstream of the washing station and includes a separate moveable chamber and part support stand. The drying station includes a plurality of nozzles plumbed to spray dry air on the part after it has been enclosed within the moveable chamber.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
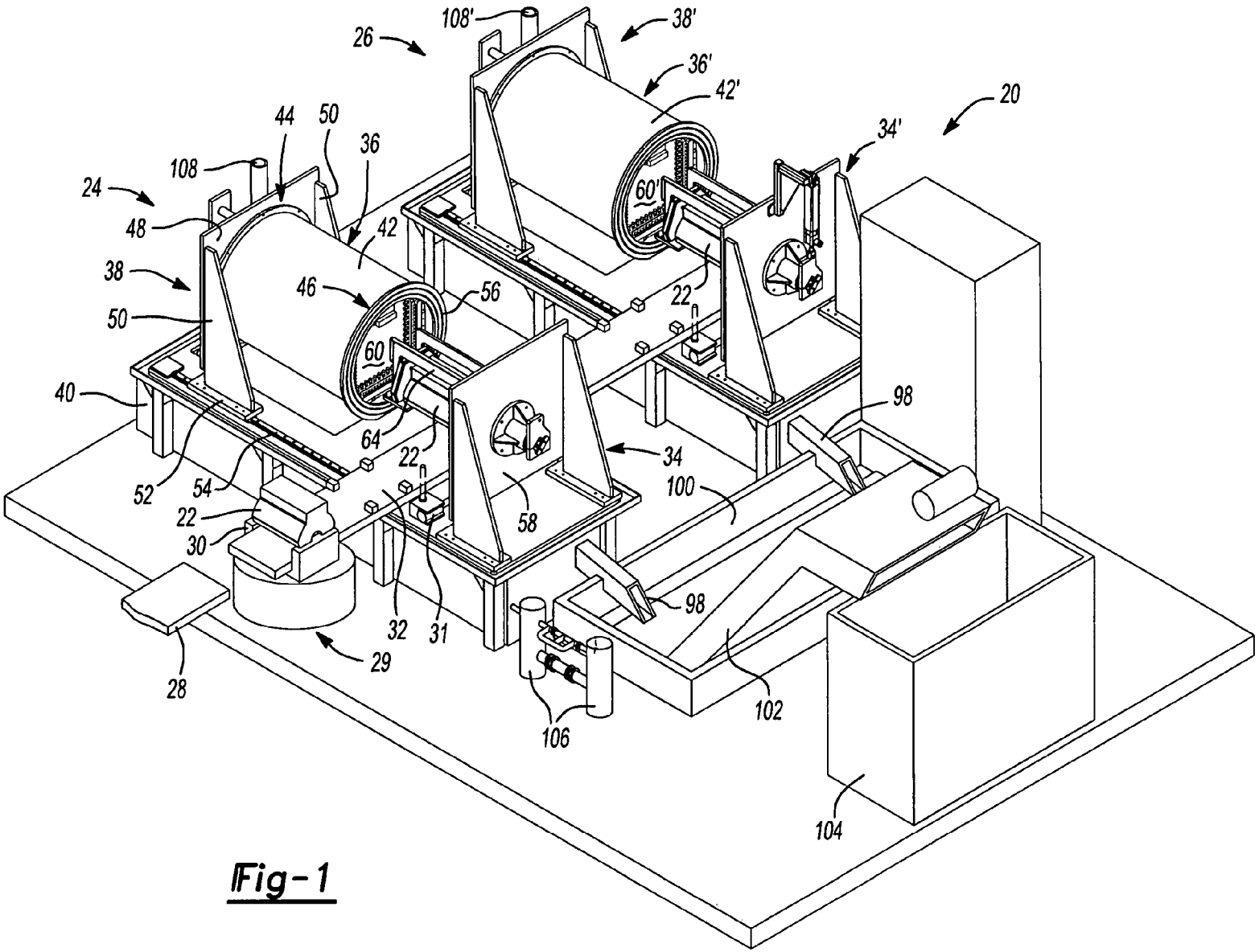
FIG. 1 is a perspective view of an industrial parts washer constructed in accordance with the teachings of the present invention.

Referring to FIG. 1, a preferred embodiment of a parts washer 20 for use in an industrial manufacturing plant to clean industrial parts or workpieces such as automotive vehicle powertrain components, including a part 22 or the like is shown. Parts washer 20 operates as a cleaning station typically positioned after a machining station (not shown) where the part has been machined by a mill, a lathe, a grinding machine or a similar industrial tool. During the machining process, lubrication, grease, dirt and burrs often adhere to the walls of internal passageways and the external surface of the machined part.

Parts washer 20 includes a washing station 24 and a drying station 26 positioned adjacent to one another. A conveyor 28 transports part 22 from a machining center (not shown) to a transfer system 29. Transfer system 29 includes a turntable 30 where part 22 is rotated into proper alignment for loading into washing station 24. Transfer system 29 also includes a lift 32 which is operable to transport a recently machined part from turntable 30 to washing station 24 and simultaneously transfer a washed part from washing station 24 to drying station 26. To accomplish this task, a driver 31 is operable to vertically move and horizontally translate lift 32 to properly position the parts 22.

Figure 2:
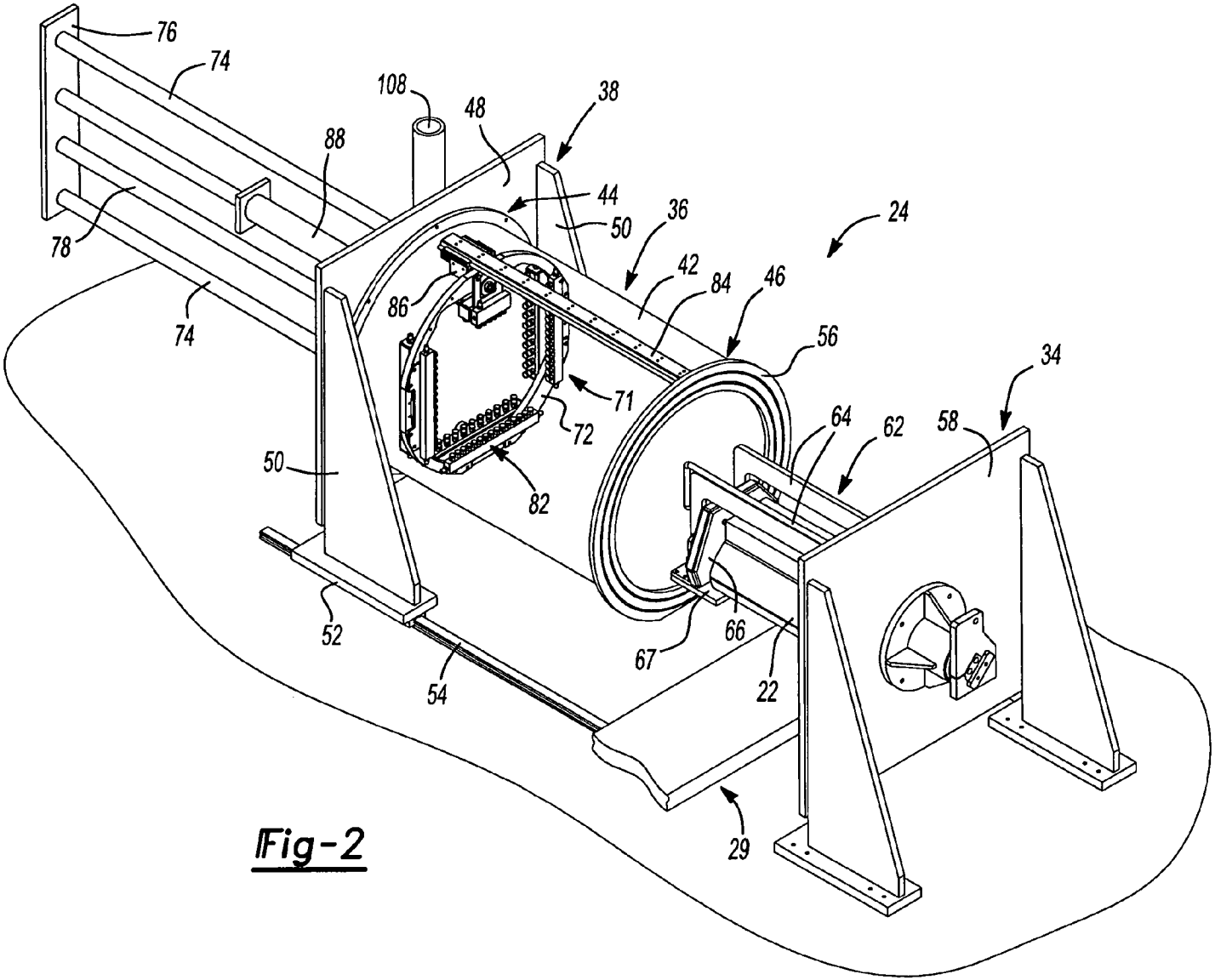
FIG. 2 is a partial perspective view depicting a washing station of the industrial parts washer of the present invention having a chamber positioned in an open position.
Figure 3:
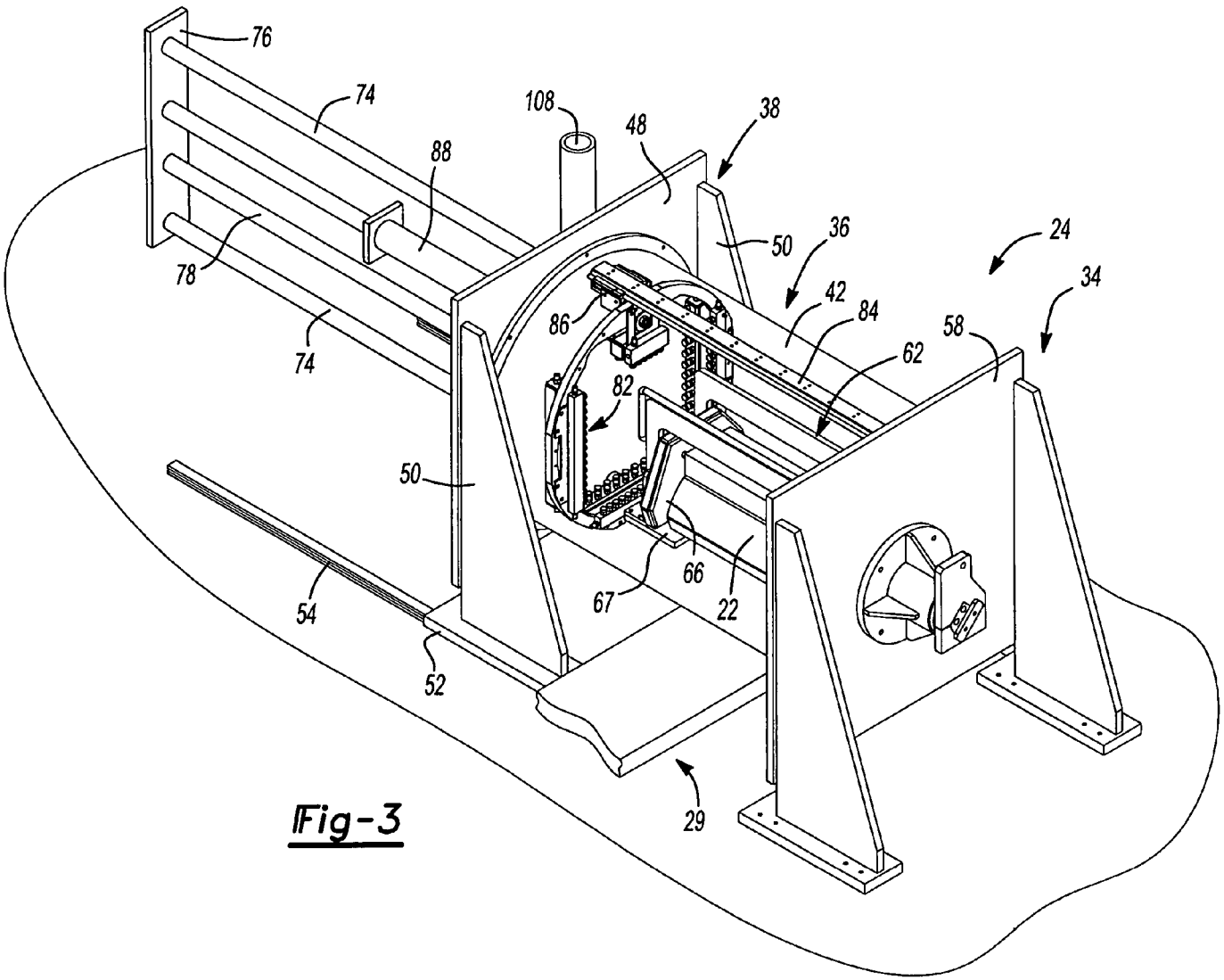
FIG. 3 is a partial perspective view depicting a washing station of the industrial parts washer of the present invention where the chamber is in a closed position.

As best shown in FIGS. 1-3, washing station 24 includes a stand 34 for supporting part 22, a chamber 36, a slide 38 and a table 40. Chamber 36 is a generally hollow cylindrical member having a wall 42, first end 44 and a second end 46. First end 44 is coupled to an end plate 48 of slide 38. Chamber 36 is preferably constructed from a lightweight, translucent material to allow an operator to view the washing process. Slide 38 includes a pair of side plates 50 coupled to end plate 48. Each side plate 50 is mounted on a carriage 52. Each carriage 52 is slidable relative to table 40 along a track 54. Chamber 36 is mounted in a cantilevered fashion having its longitudinal axis positioned substantially parallel to and spaced apart from the floor.

Based on this mounting arrangement, chamber 36 may be selectively positioned in an open position shown in FIG. 1 or a closed position as shown in FIG. 3. In the open position, second end 46 of chamber 36 is open to atmosphere and access to part 22 is allowed. When chamber 36 is in the closed position, a seal 56 located on second end 46 of chamber 36 engages a mounting plate 58 of stand 34. An enclosed volume 60 is formed inside chamber 36 once seal 56 engages mounting plate 58.

Figure 4:
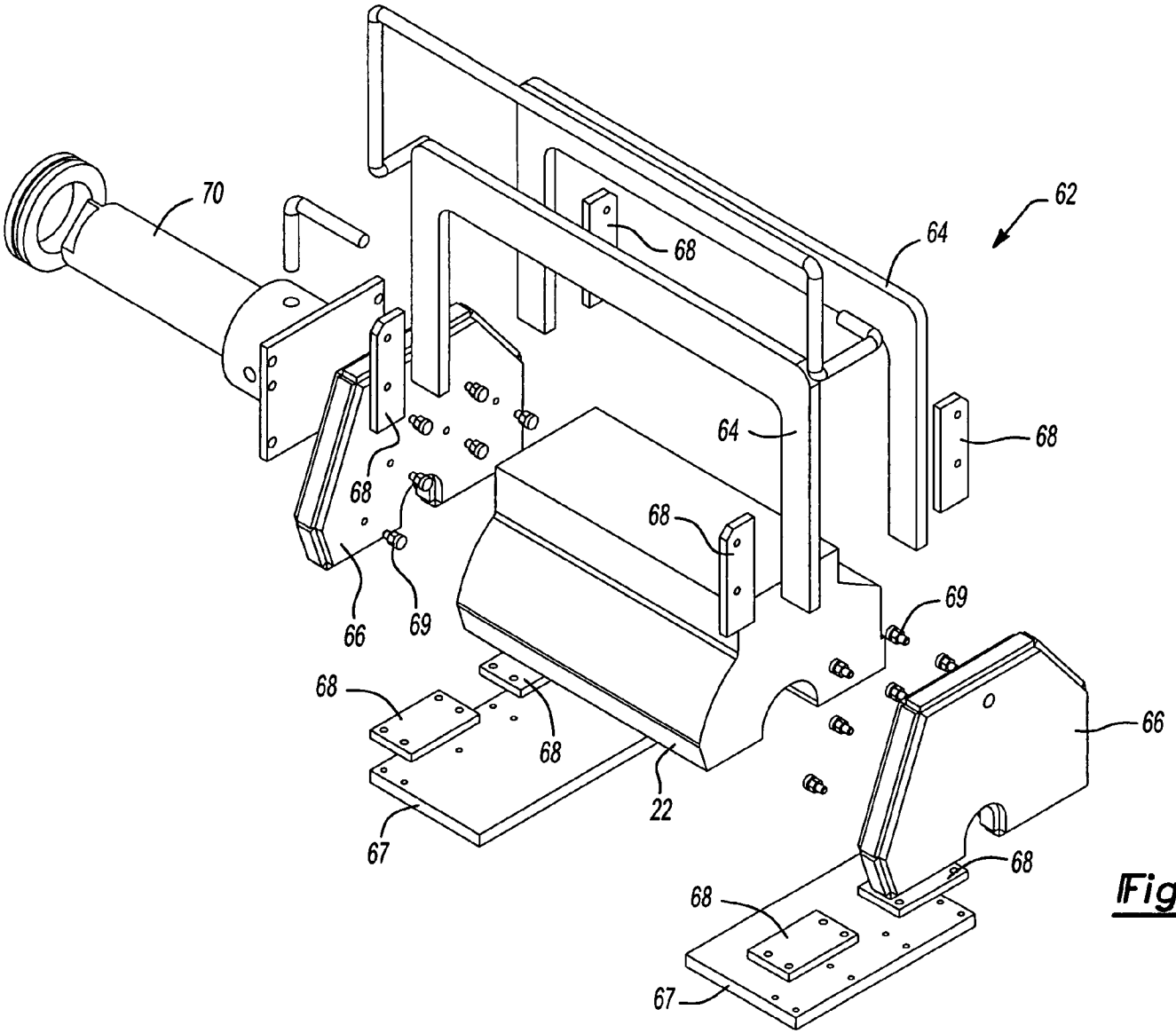
FIG. 4 is an exploded perspective view of a part support structure of the industrial parts washer of the present invention.

FIG. 4 depicts a part support structure 62 including a pair of generally "C" shaped frames 64, a pair of wash plates 66, two inwardly extending ledges 67, and a number of stop plates 68. A plurality of nozzles 69 are mounted to wash plates 66 to provide wash spray to the end portions of part 22. Ledges 67 provide support for part 22 during washing. A spindle 70 rotatably couples support structure 62 to mounting plate 58 of stand 34. Stop plates 68 retain part 22 in a desired location should there be a need to rotate the part such as during the drying phase as will be described in detail hereinafter.

Figure 5:
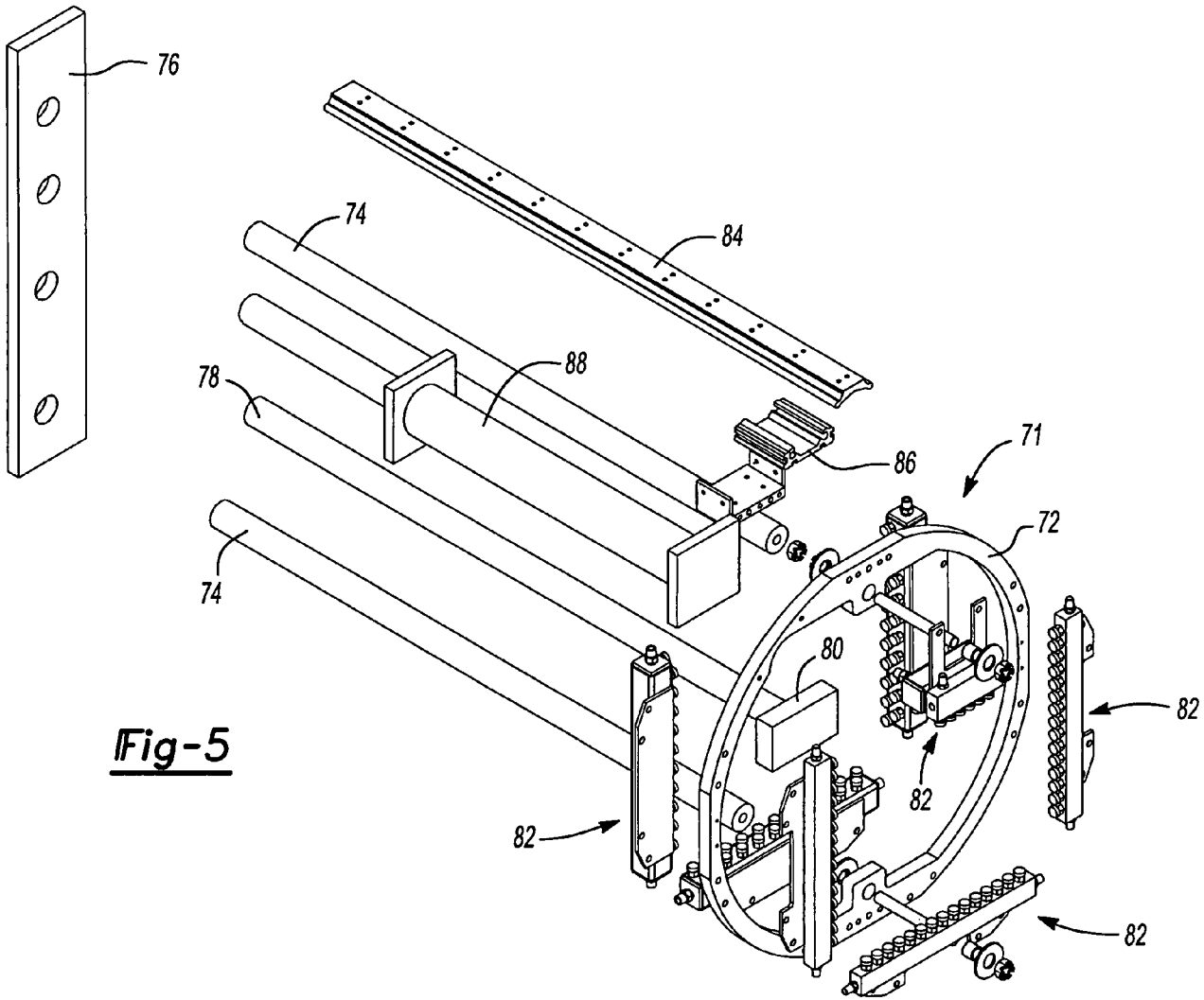
FIG. 5 is an exploded perspective view of a wash ring of the industrial parts washer of the present invention.

As best shown in FIGS. 3 and 5, a wash ring 71 is movably mounted within chamber 36. Wash ring 71 includes a halo 72 mounted to a pair of guide rods 74. Guide rods 74 extend through chamber 36 and end plate 48. Each guide rod 74 is coupled to a support 76 which maintains a proper spacing between each of the guide rods. A water supply line 78 is also coupled to support 76 and halo 72. Supply line 78 is in fluid communication with a valve assembly 80 which is controllable to selectively supply pressurized fluid to four sets of nozzles 82 mounted to halo 72. Each set of nozzles is preferably orientated orthogonally relative to an adjacent set of nozzles to provide cleaning fluid to the entire perimeter of part 22. To conserve water consumption and minimize the size of pump required to provide pressurized fluid, valve 80 is controlled to provide pressurized fluid to only one set of nozzles during a predetermined time period. Valve 80 cycles to sequentially provide pressurized to each set of nozzles independently. Valve 80 may also be controlled to divert pumped fluid directly to a reservoir during the time when chamber 36 is in the open position. This allows the pump to be continuously run thereby avoiding start and stop pumping operational concerns, thus resulting in prolonged pump/motor life, Wash ring 71 also includes a guide bracket 84 and a hanger 86. Hanger 86 is free to slide axially relative to guide bracket 84 thereby translating halo 72 and nozzles 82 within chamber 36. An actuator 88 drivingly interconnects slide 38 and halo 72 to allow wash ring 71 to be translated back and forth across part 22 during the washing process.

Halo 72 and nozzles 82 may be driven back and forth a predetermined number of times or may be controlled to continue to wash part 22 until a predetermined parameter is met indicating that the part is clean. The predetermined parameter could be an indication by a visual inspection, a measurement of particulate count in the cleaning fluid or any other number of indicia. Once the washing cycle has been determined to be completed, chamber 36 is moved from a closed position to the open position by causing slide 38 to translate relative to table 40. At this time, part 22 may be transferred to drying station 26, if present.

Drying station 26 is constructed substantially similarly to washing station 24. Accordingly, similar components will be identified with like reference numerals including a "prime" designation. Preferably, operation of drying station 26 is coordinated with operation of washing station 24 such that chamber 36 and chamber 36' are substantially simultaneously located in their open and closed positions. When both chambers are in the open position, a part 22 is transferred from turntable 30 to part support structure 62 of washing station 24 while a recently washed part is transferred from part support structure 62 to part support structure 62' of drying station 26. One skilled in the art will appreciate that the adjacent positioning of washing station 24 and drying station 26 is merely exemplary and that washing station 24 may be utilized in the absence of a companion drying station 26 without departing from the scope of the present invention.

Figure 6:
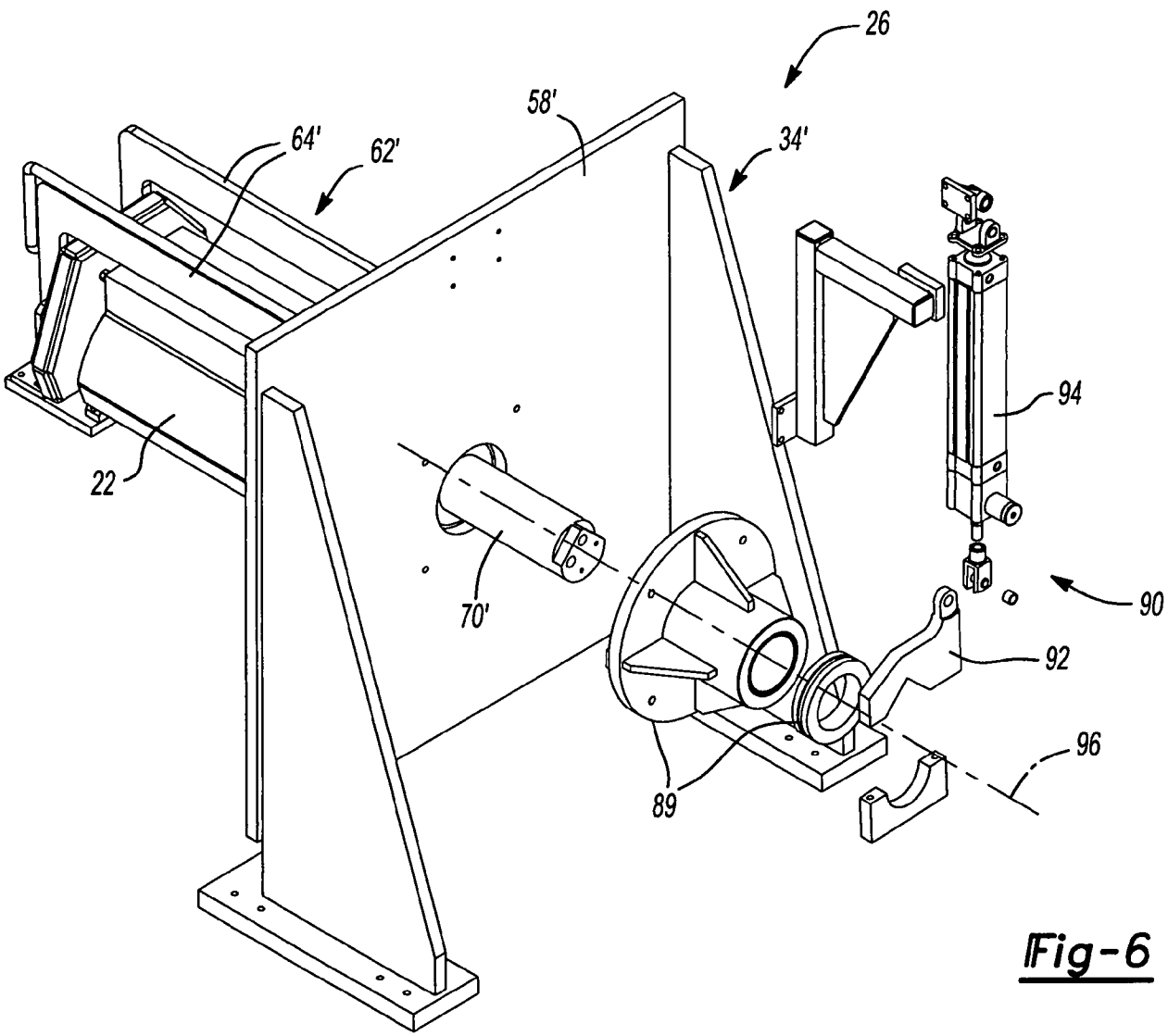
FIG. 6 is a partial exploded perspective view of a drying station of the industrial parts washer of the present invention.

During operation of drying station 26, chamber 36' is moved from the open to the closed position such that seal 56' engages mounting plate 58' of stand 34'. Compressed air or another drying agent is presented within enclosed volume 60' via nozzles 82'. Nozzles 82' may also be defined as air knives. Part support structure 62' is mounted to spindle 70' which is rotatably coupled to stand 34' by an end cap and bearing assembly 89. As shown in FIG. 6, an actuator mechanism 90 includes an arm 92 and a cylinder 94 coupled to spindle 70'. Actuator mechanism 90 functions to selectively rotate part support structure 62' and part 22 about a longitudinal axis 96.

In operation, halo 72' and air knives 82' are axially translated across part 22 while the part is located in a first orientation as shown in the Figures. Subsequently, actuator mechanism 90 causes part 22 to rotate 90 degrees to allow trapped debris and cleaning fluid to escape from internal passages of part 22. Pressurized air or dry air is again supplied to air knives 82' while actuator 88' translates halo 72' over the part.

Returning to FIG. 2, a pair of water return chutes 98 interconnect enclosed internal volume 60 and enclosed internal volume 60' to a settling tank 100. A conventional chip drag and chip waste mechanism 102 transports settled machining chips and debris from settling tank 100 to a dumpster 104. Cleaning fluid is pumped from settling tank 100 through filters 106 and re-circulated back to the supply for washing station 24. A method and apparatus for determining and maintaining the cleanliness of the fluid is described in U.S. patent application Ser. No. 10/342,977 which is hereby incorporated by reference. Parts washer 20 also includes an exhaust mist eliminator 108 which connects a vacuum source to chamber 36 and chamber 36'. Exhaust mist eliminators 108 and 108' substantially reduce the splatter of cleaning fluid during both washing and drying processes.

FIGS. 7-10 depict an alternate embodiment industrial parts washer 200. Parts washer 200 is substantially similar to parts washer 20. Parts washer 200 includes a stand 202, a tray 204 and a moveable cover 206. Tray 204 includes an open end 208 and a closed end 210. Cover 206 is axially moveable between an open position shown in FIG. 7 where cover 206 is positioned adjacent the closed end 210 and a closed position shown in FIG. 8 where cover 206 is in communication with open end 208.

Cover 206 includes a translucent semi-cylindrical center panel 212 having one end capped by a substantially planar end plate 214 and another end partially covered by arcuately shaped plate 216. An actuator 218 has a first end 220 coupled to end plate 214 and a second end 222 mounted on a frame 224. Actuator 218 is operable to linearly move cover 206 between the open position shown in FIG. 7 and the closed position shown in FIG. 8.

Figure 9:
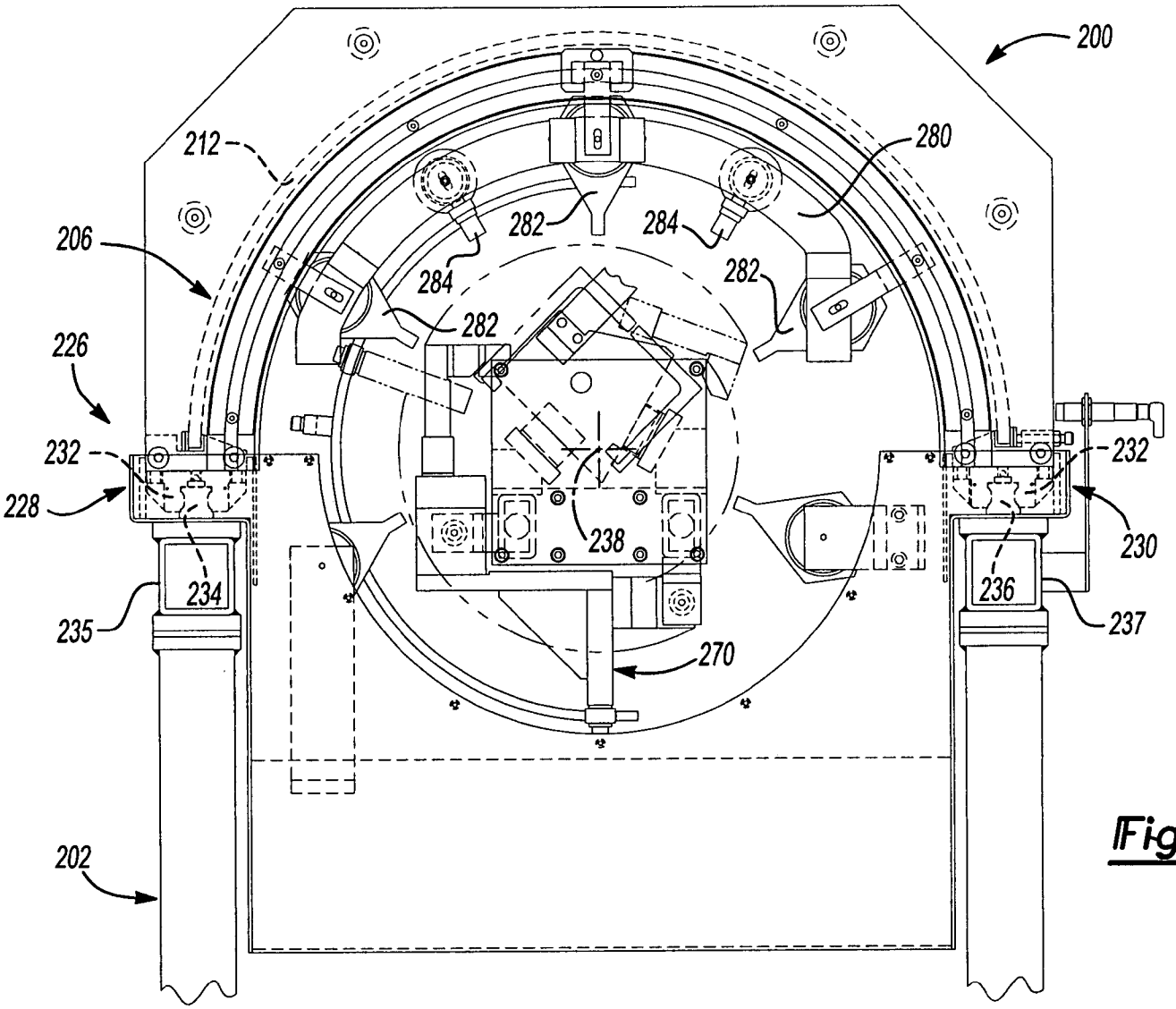
FIG. 9 is a fragmentary cross-sectional side view of the alternate embodiment industrial parts washer.

FIG. 9 depicts industrial parts washer 200 having a linear slide mechanism 226 including a first slide 228 and a second slide 230. First and second slides 228 and 230 each include a pair of guide blocks 232 coupled to center panel 212. Each guide block 232 of first slide 228 is in communication with a first guide rail 234. First guide rail 234 is mounted to a first slide support 235. Similarly, second slide 230 includes a second guide rail 236 mounted on a second slide support 237 positioned parallel to first slide support 235. Guide blocks 232 partially encapsulate their respective guide rails 234 and 236 to limit the relative movement between cover 206 and stand 202. Specifically, cover 206 is allowed to only linearly translate along a single axis relative to stand 202. The semi-cylindrical center panel 212 has a longitudinal axis 238. Cover 206 moves along an axis parallel to, or coincident with, axis 238.

Figure 10:
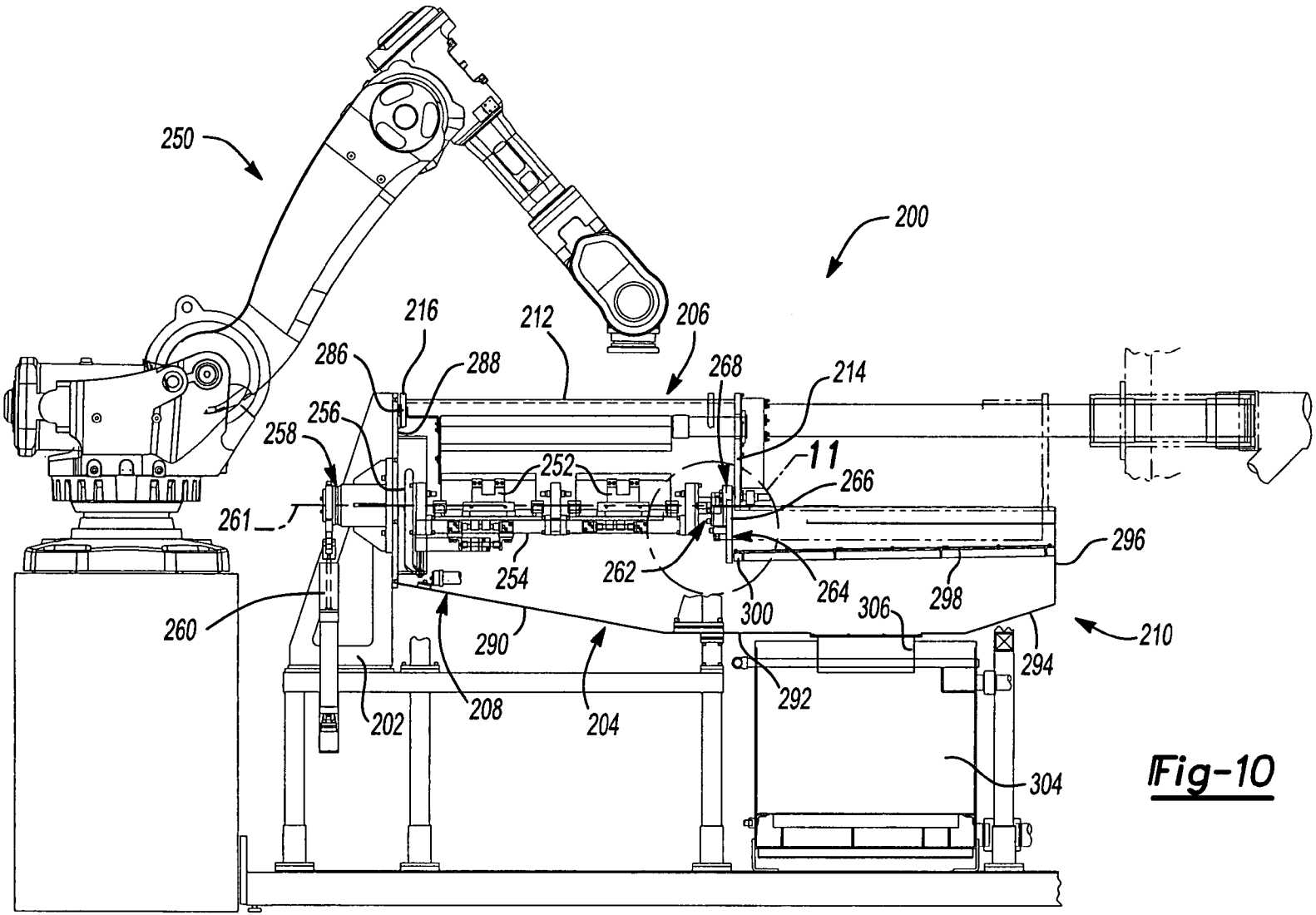
FIG. 10 is a cross-sectional side view of the industrial parts washer shown adjacent an exemplary robot.
Figure 11:
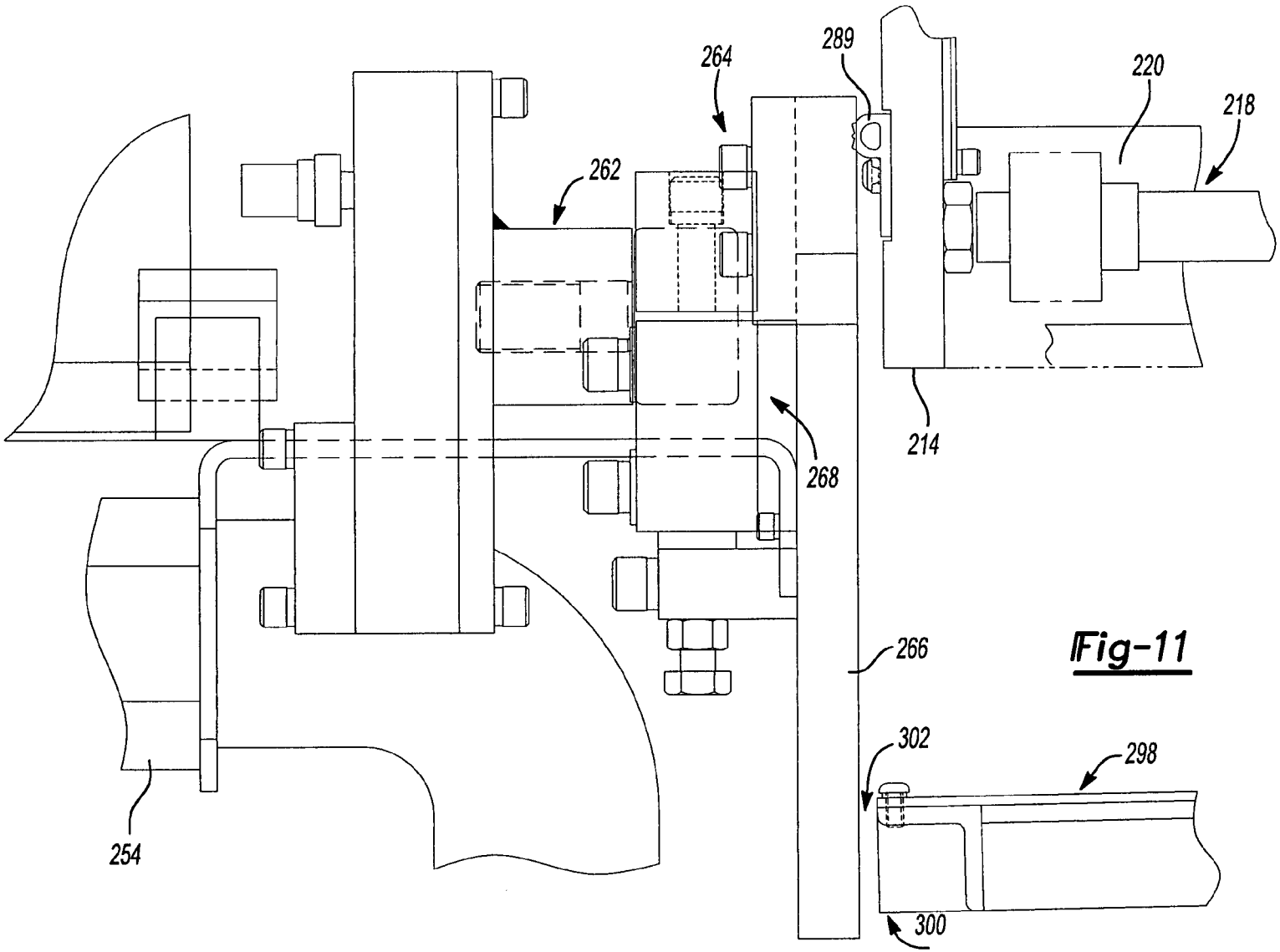
FIG. 11 is an enlarged fragmentary side view of a portion of the industrial parts washer as indicated by the phantom lines shown in FIG. 10.

FIGS. 10 and 11 show industrial parts washer 200 positioned adjacent to an exemplary robot 250. Robot 250 is operable to load parts 252 to be washed and/or unload cleaned parts 252 to and from parts washer 200. Parts 252 are mounted on a part support 254 located above open end 208 of tray 204. Part support 254 is coupled to, or integrally formed with, a rotatable shaft 256. A first end 258 of rotatable shaft 256 extends through stand 202. An actuator 260 is coupled to first end 258 such that actuator 260 is selectively operable to rotate shaft 256 and parts 252 about an axis 261. A second end 262 of shaft 256 is rotatably supported by an end stop assembly 264. End stop assembly 264 includes a vertically oriented substantially planar plate 266. Plate 266 is fixedly mounted to stand 202. End stop assembly 264 also includes a centering and support portion 268 for rotatably supporting second end 262 of shaft 256. End stop assembly 264 also includes a cam follower assembly 270 (FIG. 9) operable to restrain part support 254 and parts 252 from any motion except that of rotation about axis 261 during the washing and drying cycles.

FIG. 9 depicts a ring 280 mounted to cover 206. A plurality of nozzles 284 are coupled to ring 280. Nozzles 284 are plumbed in communication with a source of pressurized fluid. Accordingly, each nozzle 284 selectively outputs a directed spray of pressurized fluid toward one or more parts 252. A plurality of air knives 282 are also coupled to ring 280. Air knives 282 are coupled to a source of pressurized drying agent such as air. It should be appreciated that ring 280 may be mounted at a fixed location on stand 202 or on cover 206. Furthermore, ring 280 may be mounted in a manner to allow relative translation between cover 206 and ring 280. In the embodiment where the ring 280 is translatable relative to cover 206, it is contemplated that an actuator and slide mechanism be used similar to the components depicted in FIG. 5.

Figure 7:
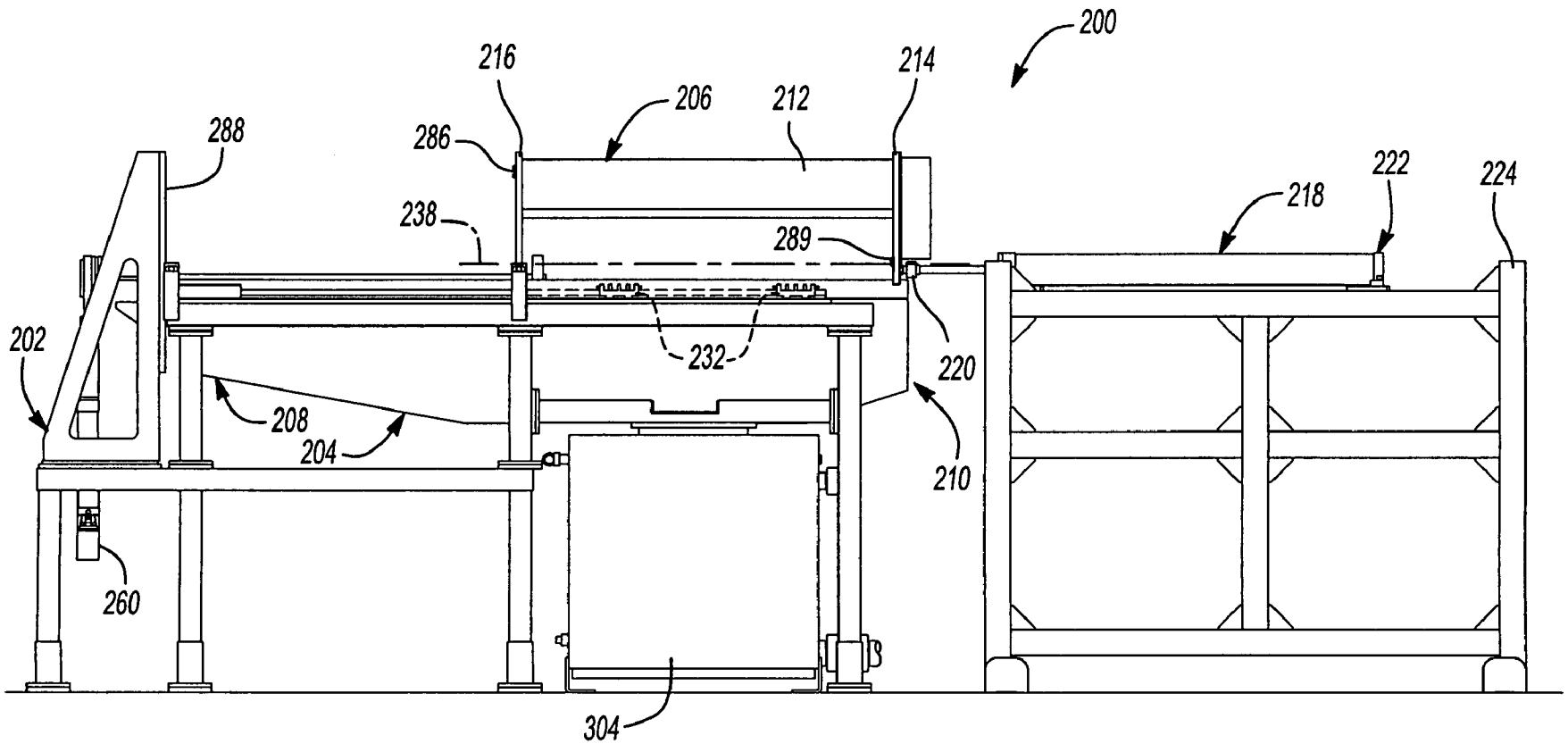
FIG. 7 is a side view of an alternate embodiment industrial parts washer showing a moveable cover in the open position.
Figure 8:
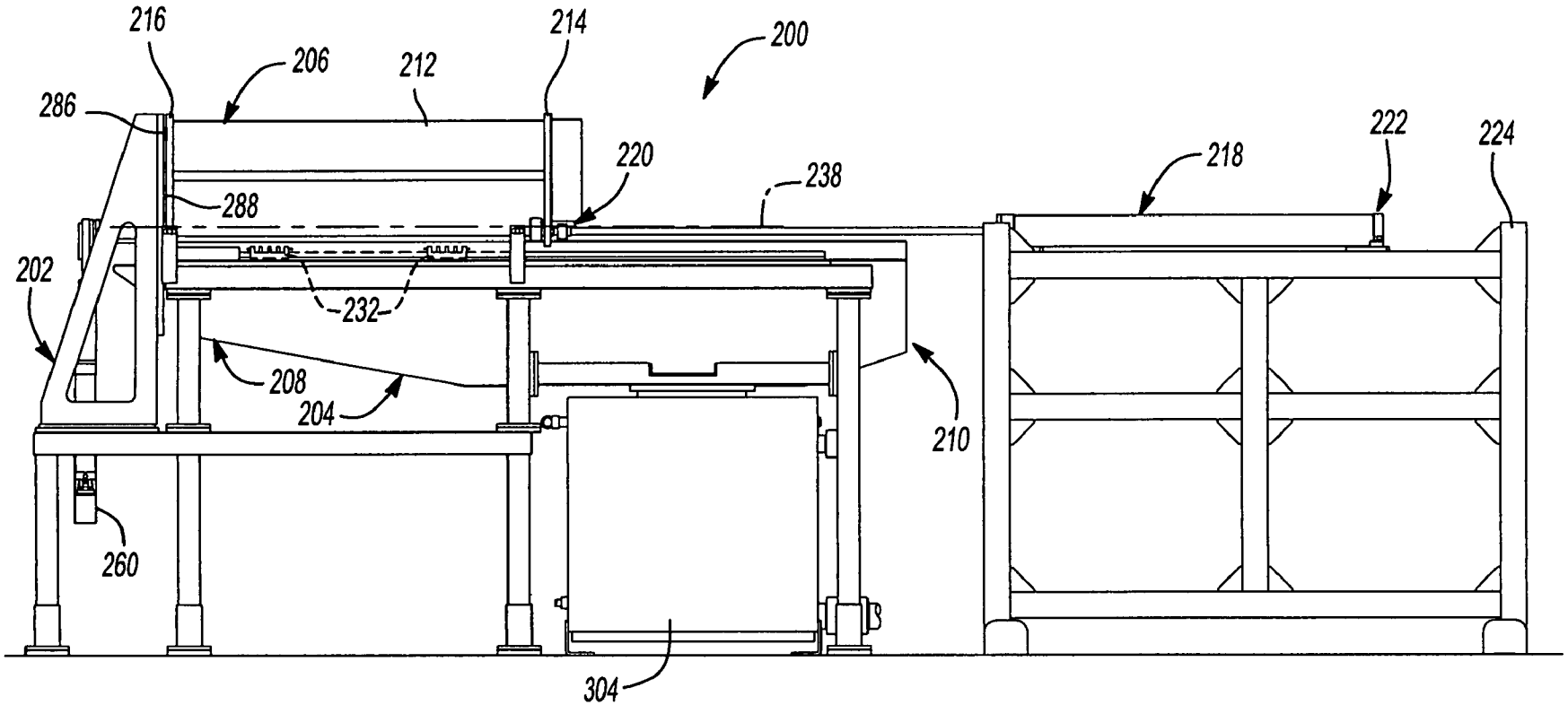
FIG. 8 is a side view of the industrial parts washer shown in FIG. 7 having a moveable cover in the closed position.

In operation, a washing and drying cycle begins by translating cover 206 to the open position shown in FIG. 7. Robot 250 picks up a part 252 requiring washing and places it on part support 254. If multiple parts are to be simultaneously washed, robot 250 or another similar robot picks up another part 252 to be washed and places it on part support 254. Once robot 250 is clear, cover 206 translates from the open position to the closed positioned depicted in FIG. 8. At this time, a first seal 286 mounted on plate 216 engages a substantially planar surface 288 of stand 202. At substantially the same time, a second seal 289 (FIG. 11) mounted on end plate 214 engages vertically oriented plate 266. A substantially sealed volume is formed to encapsulate parts 252. The substantially sealed volume is defined by plate 266, end plate 214, center panel 212, substantially planar surface 288 of stand 202 and tray 204.

Once cover 206 is located in the closed position in communication with open end 208 of tray 204, pressurized fluid is supplied to nozzles 284 to wash parts 252. Depending on the geometry of the parts to be washed, actuator 260 may or may not be actuated to cause parts to rotate within the enclosed chamber during washing. Depending on the design of the parts washer, ring 280 may or may not axially translate within the enclosed chamber during the washing and/or drying sequences.

Tray 204 includes a first angled bottom surface 290, a flat bottom surface 292 and another angled bottom surface 294. A vertical end wall 296 is located at closed end 210 of tray 204. A wash plate 298 is coupled to end wall 296. Wash plate 298 is positioned at a slight angle from being parallel with the ground such that washing fluids that may drip from cover 206 when it is located in the open position impact wash plate 298 and run down the wash plate in a right-to-left direction as viewed in FIGS. 10 and 11. A relatively small gap exists between an end 300 of wash plate 298 and plate 266 to form a passageway 302 for wash drippings to enter tray 204.

A filter and pump assembly 304 is in communication with an outlet 306 formed in tray 204 along bottom surface 292. Fluid that has been sprayed on parts 252 as well as debris that was previously clinging to parts 252 drop to the bottom of tray 204 due to gravitational forces. Within filter and pump assembly 304, the debris is filtered from the fluid to allow at least some of the fluid to be reused to clean subsequent parts.

After the washing sequence has been completed, pressurized fluid is no longer supplied to nozzles 284. Pressurized drying fluid is now supplied to air knives 282. Depending on the geometry of parts 252, actuator 260 may be actuated to rotate the parts during the drying cycle as well. Upon completion of the drying cycle, cover 206 is axially translated to the open position. At this time, robot 250 removes cleaned part 252 from industrial parts washer 200 and places them in an appropriate location.

Figure 12:
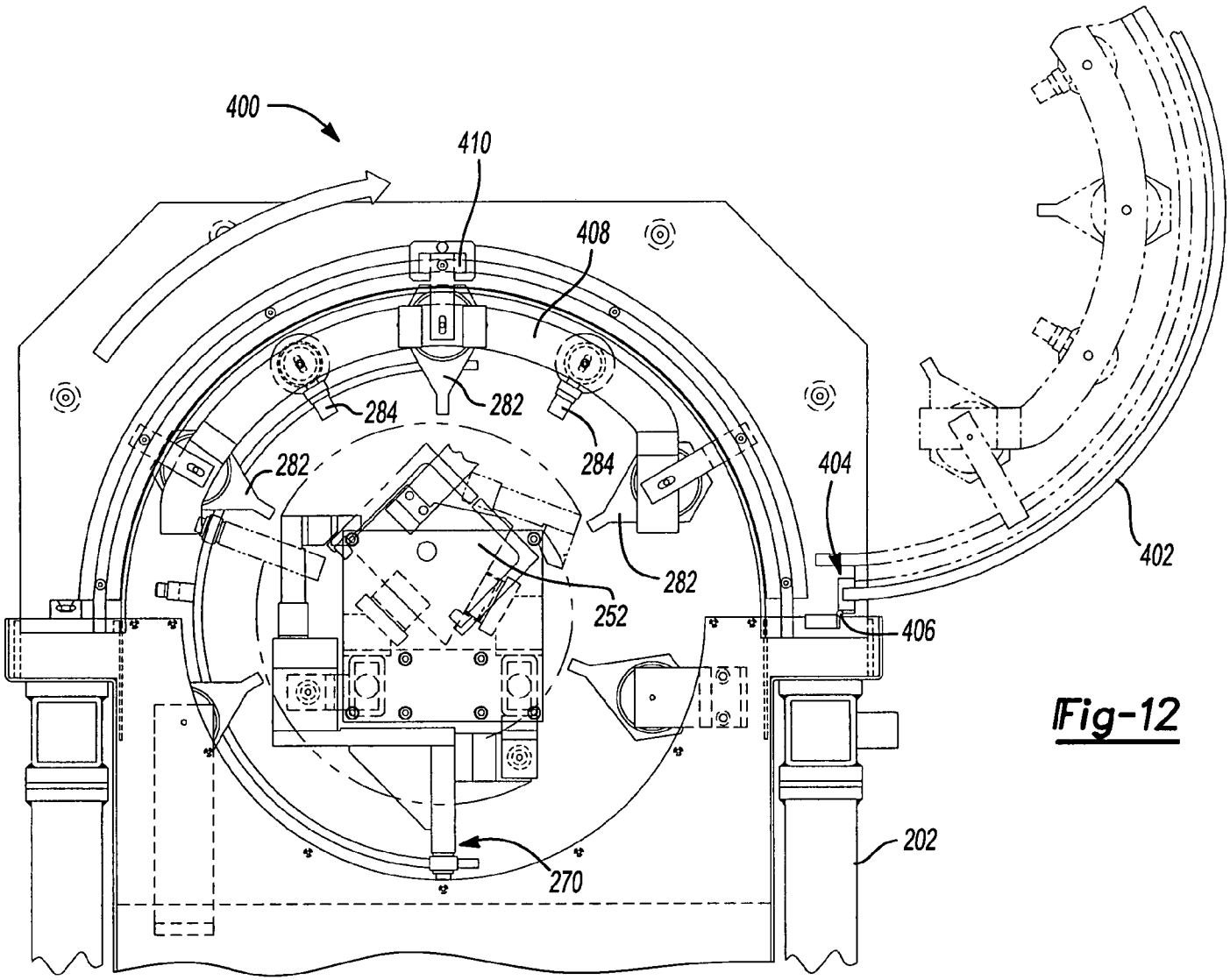
FIG. 12 is a cross-sectional end view of another alternate embodiment industrial parts washer.

FIG. 12 depicts another alternate embodiment industrial parts washer 400. Industrial parts washer 400 is substantially similar to industrial parts washer 200. Accordingly, like elements will retain their previously introduced reference numerals. Industrial parts washer 400 includes a semi-cylindrically shaped translucent cover 402. Cover 402 is rotatably coupled to stand 202 with a hinge 404. Unlike cover 206, cover 402 is rotatable about a longitudinally extending axis 406. In the embodiment depicted in FIG. 12, cover 402 does not translate relative to stand 202. A ring 408 may be mounted to stand 202 to remain in a fixed axial location. Alternatively, ring 408 may be mounted on a rail 410 that is fixed to stand 202. In this alternate embodiment, ring 408 is axially translatable relative to stand 202 and parts 252.

In yet another alternate embodiment, ring 408 may be coupled to cover 402 such that ring 408, nozzles 284 and air knives 282 rotate about axis 406 when cover 402 is moved between a closed position and the open position as depicted in phantom line representation. The remaining features of industrial parts washer 400 remain substantially similar to those previously described in relation to industrial parts washer 200. For example, parts 252 are removable from part support 254 by vertically translating parts 252 once cover 402 is placed in the open position.

Furthermore, the foregoing discussion discloses and describes merely exemplary embodiments of the present invention. For example, the washing and drying stations of the present invention may be separated and used independently from one another. Additionally, any number of spray head configurations may be used in conjunction with a moveable housing without departing from the scope of the present invention. Additionally, one skilled in the art will readily recognize from such discussion, and from the accompanying drawings and claims, that various changes, modifications and variations may be made therein without department from the spirit and scope of the invention as defined in the following claims.

What is claimed is:

1. An industrial parts washer for cleaning a part, the industrial parts washer comprising:

a stand adapted to support the part;

a chamber having a first portion and a second portion wherein the first portion is selectively moveable relative to both the stand and the second portion in a direction substantially parallel to the ground, the first portion being moveable from a first position clear of the part to a second position covering the part, said stand, said first portion and said second portion forming a substantially sealed volume encapsulating the part when said first portion is in said second position; and a nozzle coupled to a pressurized fluid supply, said nozzle being positioned within said chamber and adapted to spray fluid on the part, wherein the second portion includes a tray fixed to the stand, the tray having an open end and a closed end, the first portion being positioned in communication with the open end when in the second position to form the substantially sealed volume, the first portion being positioned over the closed end when in the first position.

2. The industrial parts washer of claim 1 wherein the second portion includes an outlet coupled to the pressurized fluid supply such that the fluid sprayed on the part is returned for subsequent spraying.

3. The industrial parts washer of claim 1 wherein the stand includes a stanchion and a rotatable shaft adapted to support the part, the rotatable shaft being supported at one end by the stanchion.

4. The industrial parts washer of claim 3 further including an actuator coupled to the rotatable shaft, the actuator being operable to rotate the rotatable shaft relative to the stanchion.

5. The industrial parts washer of claim 4 further including a member rotatably supporting an opposite end of the rotatable shaft, wherein the rotatable shaft includes a provision adapted to support the part at a location axially between the one end and the opposite end.

6. The industrial parts washer of claim 5 wherein the first portion forms a seal with the member when the first portion is in the second position.

7. The industrial parts washer of claim 6 wherein the member includes a plate having a vertically oriented substantially planar surface positioned adjacent to a vertical end wall of the first portion when the first portion is in the second position.

8. The industrial parts washer of claim 1 wherein the first portion includes a substantially planar end plate capping a semi-cylindrically shaped center panel.

9. The industrial parts washer of claim 8 further including a linear slide mechanism interconnecting the first portion and the stand.

10. The industrial parts washer of claim 9 wherein the linear slide mechanism includes a guide rail coupled to the stand and a guide block coupled to the first portion, wherein the guide block is moveable relative to the guide rail along only a single axis.

11. The industrial parts washer of claim 8 wherein the center panel is translucent.

12. The industrial parts washer of claim 1 wherein the industrial parts washer is configured to allow the part to be positioned within the chamber and removed from the chamber by moving the part along a vertical axis when the first portion is in the first position.

13. The industrial parts washer of claim 1 wherein the first portion is rotatable about a longitudinally extending axis.

14. An industrial parts washer for cleaning a part, the industrial parts washer comprising:

a stand adapted to support the part;

a basin having a first end with an open top and a second end with a closed top;

a cover selectively moveable relative to the basin between a first position above the closed top and a second position in communication with the first end, the stand, the basin and the cover defining a substantially closed volume when the cover is in the second position; and a nozzle being positioned within the closed volume and adapted to spray pressurized fluid on the part.

15. The industrial parts washer of claim 14 wherein the nozzle is coupled to the cover and moveable therewith.

16. The industrial parts washer of claim 15 wherein the basin includes a wash panel located at the second closed end, the wash panel being angled to cause fluid dripping from the cover at the first position to enter the basin.

17. The industrial parts washer of claim 16 wherein the cover is coupled to the stand with a linear slide mechanism.

18. The industrial parts washer of claim 17 wherein the cover is semi-cylindrically shaped.

19. The industrial parts washer of claim 18 wherein the cover includes substantially co-planar side faces, the linear slide mechanism being coupled to the side faces.

20. The industrial parts washer of claim 18 wherein the semi-cylindrical shape of the cover includes a longitudinal axis, the cover being translatable along an axis parallel to the longitudinal axis.

21. The industrial parts washer of claim 14 wherein a first end of the cover sealingly engages the stand and a second end of the cover sealingly engages a vertically aligned plate coupled to the stand.

22. The industrial parts washer of claim 14 wherein the cover is rotatably mounted to the stand.

23. A method of operating an industrial parts washer including a stand, a basin, a moveable cover and a nozzle, the method comprising:

moving the cover horizontally relative to the stand and the basin to an opened position to allow access to a chamber;

placing a part within the chamber;

moving the cover to a closed position to enclose the part within the chamber;

positioning the cover over an open end of the basin when the cover is in the closed position;

spraying pressurized washing fluid from the nozzle toward the part;

collecting sprayed fluid and washed debris in the basin;

spraying pressurized drying agent on the part;

moving the cover to the opened position; and removing the cleaned part from the chamber.

24. The method of claim 23 further including translating the nozzle relative to the part while spraying pressurized washing fluid.

25. The method of claim 24 wherein moving the cover includes linearly translating the cover relative to the basin.

26. The method of claim 24 wherein moving the cover includes rotating the cover relative to the basin.

27. The method of claim 23 further including positioning the cover over a closed end of the basin when the cover is in the open position.

28. The method of claim 23 wherein placing a part within the chamber includes vertically translating the part.

29. The method of claim 23 further including rotating the part while spraying pressurized washing fluid.

* * * * *